United States Patent [19]

Helena

[11] 4,047,167

[45] Sept. 6, 1977

[54] RELAXATION SWITCH

[76] Inventor: Bill F. Helena, 6365 Greenway Road, Fort Worth, Tex. 76116

[21] Appl. No.: 713,698

[22] Filed: Aug. 12, 1976

[51] Int. Cl.[2] ..... G08B 13/14

[52] U.S. Cl. ..... 340/280; 200/51.1; 340/220; 340/275; 340/421

[58] Field of Search ..... 340/421, 280, 275, 220; 200/51.1, 51.14

[56] References Cited

U.S. PATENT DOCUMENTS

| | | | |
|---|---|---|---|
| 617,464 | 1/1899 | Holmes | 200/51.1 |
| 3,710,370 | 1/1973 | Quilici et al. | 340/275 |

*Primary Examiner*—Glen R. Swann, III

*Attorney, Agent, or Firm*—Wofford, Felsman, Fails & Zobal

[57] ABSTRACT

An electrical switch has a switch member having a normally bowed portion adapted to be flattened by a holding member to move an edge of the switch member to a position out of engagement with an electrically conducting member and to move the edge of the switch member to a position into engagement with the electrically conducting member when the holding member is removed and the normally bowed portion is allowed to assume its normally bowed position. The switch is particularly adapted to be used in conjunction with a CB antenna connected to a motor vehicle for sounding an alarm if the antenna is removed.

4 Claims, 7 Drawing Figures

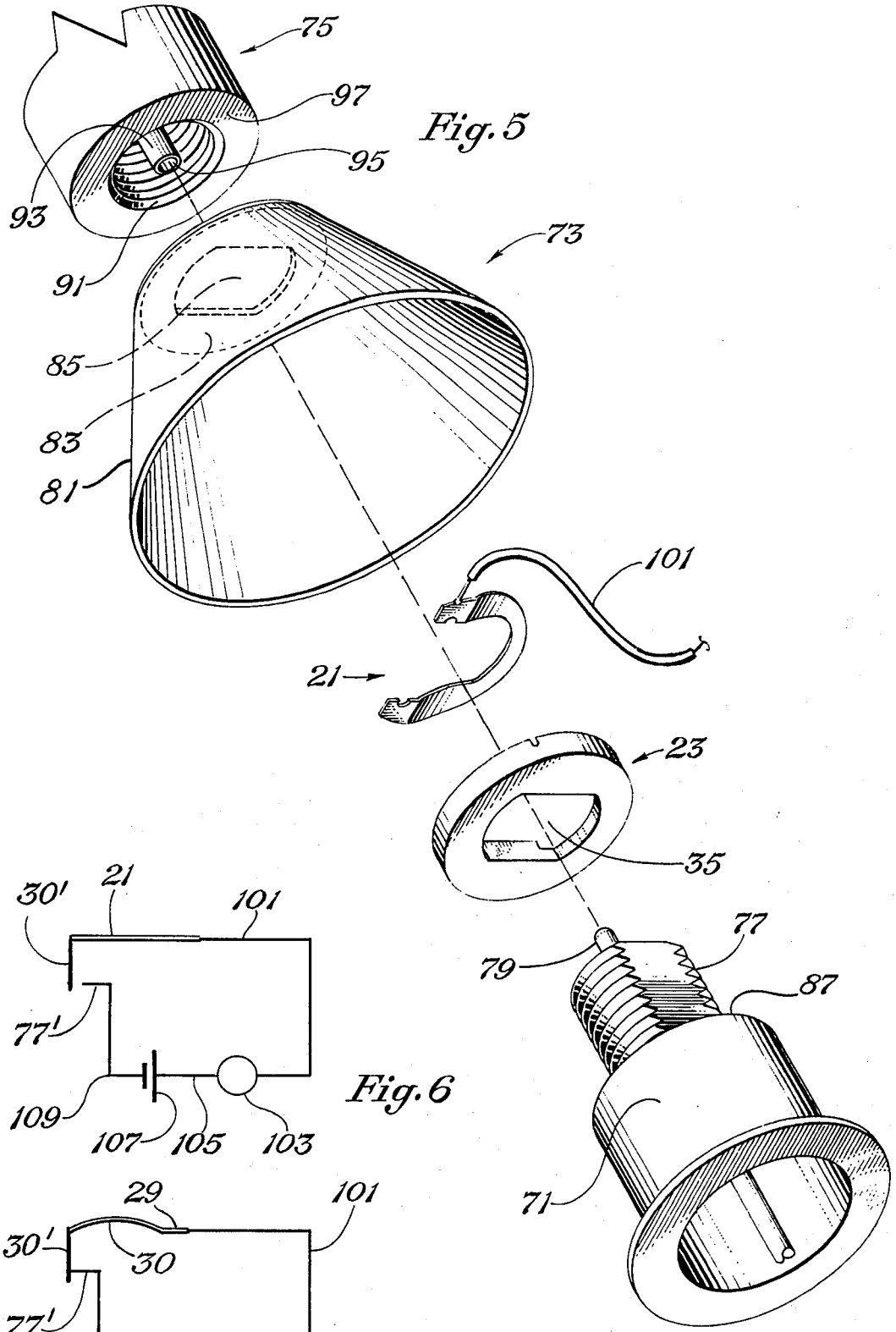
Fig. 5
Fig. 6
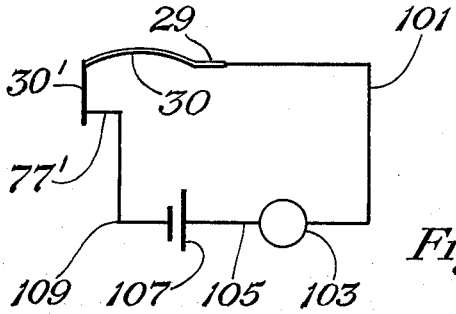
Fig. 7

RELAXATION SWITCH

BACKGROUND OF THE INVENTION

CB radios in automobiles and trucks currently are enjoying much popularity, however, the antennas for these radios are expensive and are readily stolen since most of them are merely threaded onto a base member secured to the automobile or truck.

SUMMARY OF THE INVENTION

It is an object of the present invention to provide an electrical switch which closes when a holding member is removed and is particularly adapted to be used in conjunction with a motor vehicle antenna to sound an alarm if the antenna is removed.

The switch comprises a switch means having a portion which is normally bowed. The normally bowed portion is adapted to be flattened by a holding member to move the switch means to a position out of engagement with an electrically conducting member and to move the switch means into engagement with the electrically conducting member when the holding member is removed and the normally bowed portion is allowed to assume its normally bowed position.

BRIEF DESCRIPTION OF THE DRAWINGS

FIG. 5 is a partially exploded view of an antenna and also the switch of the present invention; and FIGS. 6 and 7 are electrical schematics illustrating the manner in which the switch of the present invention is employed to actuate an alarm.

Figure 1:
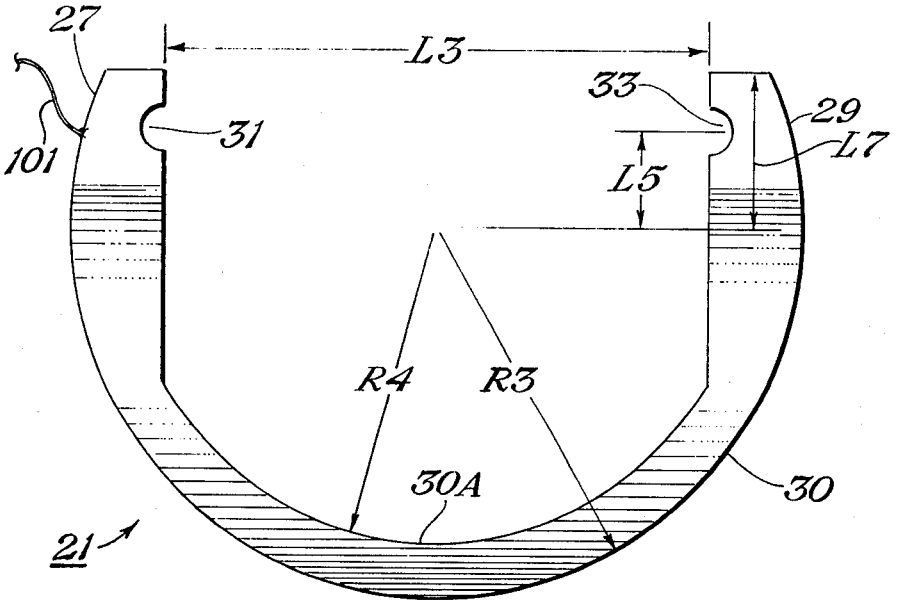
FIG. 1 is a top view of the switch member of the present invention.
Figure 2:
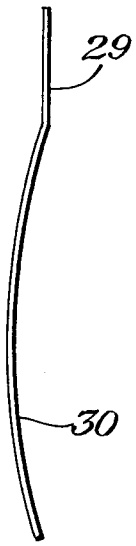
FIG. 2 is a side view of FIG. 1.
Figure 3:
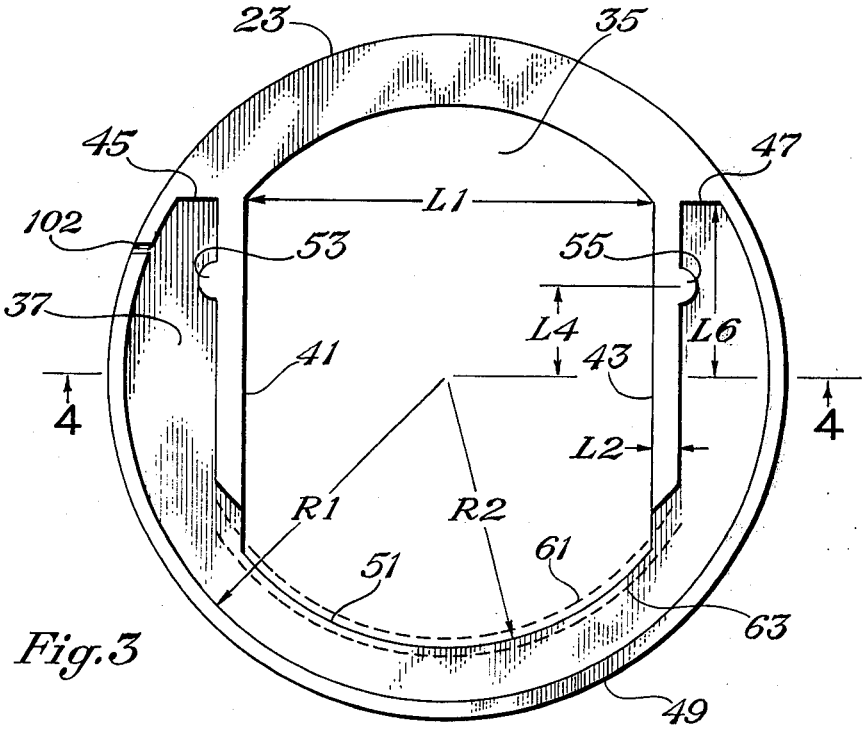
FIG. 3 is a top view of a base member to which the switch member of FIG. 1 is connected.
Figure 4:
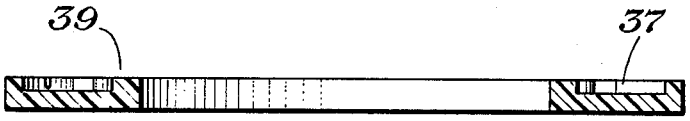
FIG. 4 is a cross-sectional view of FIG. 3 taken along the lines 4—4 thereof.

DETAILED DESCRIPTION OF THE INVENTION:

Referring now to FIGS. 1–4 of the drawings, the switch of the present invention comprises a thin metal spring member 21 and a base member 23. The spring member 21 may be formed of spring brass and have a thickness of about 0.0156 of an inch while the base member 23 is formed of an electrically insulating material. The spring member 21 is arcuate in shape and comprises two flat portions 27 and 29 connected to a normally bowed arcuate portion 30. As seen in FIG. 2, the bowed portion 30 normally bow away from the plane of the flat portions 27 and 29. The bowed portion 30 may be flattened as will be described below. The flat portions 27 and 29 have two notches 31 and 33 formed in their inside edges.

The base member 23 is a flat circular member and has a central aperture 35 formed therethrough. A channel 37 is formed in the top side 39 of the base member 23 and is defined by inner side walls 41 and 43, walls 45 and 47, and an outer side wall 49. The inner edge 51 of the channel 37 does not have an inner wall. The shape of the channel 37 is similar to that of the spring member 21 whereby it may receive the spring member 21. The dimensions of the base member 23 in inches are as follows. R1 is equal to 0.47; R2 is equal to 0.400; L1 is equal to 0.630; L2 is equal to 0.0312; L4 is equal to 0.125 and L6 is equal to 0.250. The dimensions in inches of the spring member when the bowed portion 30 is flattened are as follows. R3 is equal to 0.468; R4 is equal to 0.4055; L3 is equal to 0.75; L5 is equal to 0.125; and L7 is equal to 0.20.

Formed on the side walls 41 and 43 are two outward protruding members 53 and 55 which are adapted to be fitted into notches 31 and 33 respectively of the spring member 21 (when it is located in the channel 37) for holding the flat ends 27 and 29 of the spring member securely in place relative to the base member 23. When the spring member 21 is secured in the channel 37 in this manner the bowed portion 30, when in its normal bowed position, will extend beyond the top surface 39 (See FIG. 4.) of the base member 23. The portion 30 of the spring member 21 is free to move relative to the base member 23 as it is flattened or released to assume its normally bowed position. When the bowed portion 30 is released to assume its normally bowed position, the inner edge 30A is located radially inward of the edge 51 of the base member as depicted by dotted line 61. When the bowed portion 30 is flattened against the base member 23 it is moved radially outward to a position where its inner edge 30A is located radially beyond the edge 51 of the base member 23 as depicted by dotted line 63.

The switch of FIGS. 1–4 is particularly adapted to be used in conjunction with a motor vehicle antenna and an alarm system to sound an alarm if the antenna is removed by thieves. Reference is made to FIG. 5 for a description of the manner in which FIG. 1–4 may be used in combination with a motor vehicle antenna. The antenna is a typical CB antenna and comprises a metal base 71 adapted to be fixedly secured to the motor vehicle, a skirt 73, and rod portion 75 adapted to be attached to the base through the top of the skirt 73. The base 71 has an upper threaded male portion 77 and an antenna element 79 extending through the base 71. The threaded male portion 77 has two opposite rounded surfaces in which the threads are formed and two opposite flat surfaces. The aperture 35 of the base member 23 conforms with the cross-section of the male portion 71. The skirt 73 is formed of electrically insulating material and comprises a truncated cone portion 81 with an upper top wall 83 having an aperture 85 formed therethrough which conforms to the cross-section of the male member 77. The skirt 73 is fitted around the base 71 by inserting the male portion 77 through the aperture 85 until the lower surface of the top portion 83 of the skirt abuts the shoulder 87 of the base 71. In this position, the male portion 77 protrudes through the top of the skirt and the truncated cone 81 surrounds the base 71. The lower end of the rod portion 75 has a threaded aperture 91 formed therein and an upper antenna portion 93 located in the aperture 91 and which extends upward through the rod portion 75 to define the antenna. The lower end of the antenna 93 has an aperture 95 formed therein to receive the upper end of the antenna portion 79 of the base 71. The antenna will extend upward a certain length and also will have coupled thereto a loading coil. Antennas of this type are illustrated in INTRODUCTION TO ANTENNAS, First Edition, Fourth Printing—1975, Copyright 1972 by Radio Shack, a Tandy Corporation Company, Fort Worth, TX 76107, Library of Congress Catalog Number 72-76079, Pages 105–107. In assembling the antenna, the rod portion 75 is threaded onto the male portion 77 of the base 71 until its lower end 97 abuts against the top 83 of the skirt. In this position, the upper end of the antenna portion 79 of the base 71 will be located in the aperture 95 of the antenna 93 and in contact therewith to establish electrical connection between antenna portions 79 and 93.

The aperture 35 of the base member 23 and the inner surface of the spring member 21 conform to the cross-section of the male portion 77 of the base 71 of the antenna. In assembling the switch to the antenna, the spring member 21 is attached to the base member 23 by fitting the notches 31 and 33 around the projections 53 and 55 respectively such that the bowed portion 30 bows upward. The switch is then fitted around the male portion 77 such that the male portion 77 extends through the aperture 35 of the base member 23 with the spring member 21 attached thereto. The skirt next is fitted in place over the switch with the male portion 77 of the base 71 extending through aperture 85. The antenna 75 then is threaded in place to the male portion 77 of the base 71. When the lower end 97 of the rod portion 75 engages the upper surface of the top 83 of the skirt 73, as it is threaded to the male portion 77, it will cause the lower surface of the top 83 of the skirt to engage the bowed portion 30 of the spring member 21 and flatten it to move its edge 30A to the dotted position 63 where it is out of engagement with the male portion 77 of the base 71. If the rod portion 75 is unthreaded and removed, the bowed portion 30 of member 21 will push the skirt 73 upward and will assume its bowed position and move its inner edge 30A to the position illustrated by dotted line 61 where it will engage the male portion 77 of the antenna base 71.

Also referring to FIGS. 6 and 7, a wire 101 is attached to the spring member 21 and is connected to a conventional electrically actuated sound alarm or bell 103 hidden in the automobile. The wire 101 extends through the notch 102 formed in wall 49 of the base member 23 and under the skirt 73 where it cannot be disconnected without removing the skirt 73. The alarm 103 is electrically connected by way of conductor 105 to one side of the battery 107 of the automobile. The other side of the battery is connected by way of a conductor 109 to the antenna base 71 and hence to the male portion 77. In FIGS. 6 and 7 the male member 77 is depicted by line 77' and the inner edge 30A of the spring member 21 is depicted by line 30'. When the antenna rod 75 is threaded in place, the circuit will be incomplete as illustrated in FIG. 6 and the alarm will not be allowed to actuate. When the antenna rod 75 is removed the bowed portion 30 of the spring member 21 will then be allowed to assume its normally bowed position and move its inner edge 30A (engaging portion) into engagement with the male portion 77 of the antenna base 71 thereby completing the circuit and causing the alarm to sound.

Although the switch of the present invention has been described as used in conjunction with a motor vehicle antenna to actuate an alarm if the antenna is removed, it is to be understood that it may be used in other situations where a member is removed to allow the bowed portion 30 of the spring member 21 to assume its normally bowed position to move its inner edge 30A into engagement with a conductor to perform a function. In addition, it is to be understood that the bowed spring member 21 may have other shapes than that shown and described. If the shape of the spring member 21 is changed the shape of the base member 23 also will be changed.

I claim:

1. An electrical switch, comprising:

electrically conducting switch means having a resilient normally bowed portion, said normally bowed portion being adapted to be flattened by the application of pressure thereto, a base member, an electrically conducting means located in a given position relative to said base member, connection means for securing said switch means to said base member with an engaging portion of said switch means being free to move relative to said electrically conducting means when said normally bowed portion is flattened and when said normally bowed portion is allowed to assume its normally bowed position, said electrically conducting means being located such that said engaging portion of said switch means is out of engagement with said electrically conducting means when said normally bowed portion is flattened but engages said electrically conducting means when said normally bowed portion is allowed to assume its normally bowed position, and removable holding means adapted to be located in a predetermined position for normally flattening said normally bowed portion of said switch means to cause said engaging portion to be located out of engagement with said electrically conducting means.

2. The electrical switch of claim 1 wherein:

said holding means when removed from said predetermined position allows said portion of said switch means to assume its normally bowed position, and an electrically actuated alarm system and a source of electrical power are electrically connected to said switch means and to said electrically conducting means such that said alarm system is actuated when said holding means is removed from predetermined position.

3. An electrical switch adapted to be coupled to an antenna of a motor vehicle and to be closed in the event that the antenna is removed from the motor vehicle, said antenna comprising a metallic base means with a projecting threaded male member to be affixedly attached to a motor vehicle; an electrically insulating skirt with a top portion having an aperture formed therethrough for receiving said male member and to fit around said base means; and antenna structure having a threaded aperture at its end adapted to be threaded to said male member extending through said skirt, said electrical switch comprising:

an electrically insulating base member having an aperture formed therethrough to receive said male member of said antenna and to be located between said base means and the top portion of said skirt of said antenna, an electrically conducting switch means comprising an arcuate member having a normally bowed resilient portion, said switch means being connected to said base member such that when said normally bowed portion is flattened, an engaging portion of said switch means is moved radially outward to a location out of engagement with said male member of said antenna and when said normally bowed portion is allowed to assume its normally bowed position, said engaging portion of said switch means is moved radially inward to a location in engagement with said male member, said top portion of said skirt being adapted to flatten said normally bowed portion of said switch means when said skirt is fitted in place around said male member of said base means and when said antenna structure is threaded in place to said male member to said base means, said top portion of said skirt allowing said normally bowed portion of said switch means to assume its normally bowed position when said antenna structure is unthreaded from said male member of said base means.

4. The electrical switch of claim 3 comprising:

an electrically actuated alarm means and a source of electrical power electrically connected to said switch means and to said base means such that said alarm system is actuated when said antenna structure is unthreaded from said male member of said base means.

* * * * *